United States Patent [19]

Fukutani

[11] 3,937,162

[45] Feb. 10, 1976

[54] DEVICE FOR USE IN DEMOLISHING A CONSOLIDATED AND HARDENED SLURRY BODY REMAINING IN THE HOLD OF AN IRON-ORE CARRIER

[75] Inventor: Mitsuo Fukutani, Nagasaki, Japan

[73] Assignees: Kobe Steel Ltd., Kobe; Mitsubishi Heavy Industries, Ltd., Tokyo, both of Japan

[22] Filed: Apr. 12, 1973

[21] Appl. No.: 350,591

[30] Foreign Application Priority Data

Apr. 12, 1972 Japan ..... 47-36631

[52] U.S. Cl. ..... 114/0.5 R; 15/93 R; 15/104.1 C; 15/246.5

[51] Int. Cl. ..... B63b 35/00

[58] Field of Search ..... 114/.5 R, .5 T, 73, 222; 15/246.5, 104.07, 104.1 C, 93 R

[56] References Cited

UNITED STATES PATENTS

| | | | |
|---|---|---|---|
| 1,565,875 | 12/1925 | Von Haase | 214/89 |
| 3,113,390 | 12/1963 | Pewtheis | 37/DIG. 18 |
| 3,346,300 | 10/1967 | Grant | 15/104.1 C |
| 3,471,888 | 10/1969 | Grant et al. | 15/104.07 |
| 3,494,485 | 2/1970 | Hasegawa | 214/89 |
| 3,677,604 | 7/1972 | Leyrat | 37/DIG. 18 |

FOREIGN PATENTS OR APPLICATIONS

| | | | |
|---|---|---|---|
| 147,223 | 12/1962 | U.S.S.R. | 15/246.5 |
| 410,726 | 3/1925 | Germany | 15/104.1 C |

*Primary Examiner*—Frank E. Werner
*Assistant Examiner*—Donald W. Underwood
*Attorney, Agent, or Firm*—Oblon, Fisher, Spivak, McClellan & Maier

[57] ABSTRACT

A device is disclosed for use in demolishing a consolidated and hardened slurry body remaining in the form of a wall along the sidewalls of a hold in a ship or the like, being particularly useful in a wet-loading and dry-unloading method used in an iron-ore carrier which is loaded with iron-ore in a slurry state in its hold. For demolishing slurry walls, an arm having reciprocating edges at opposite ends thereof is extended downwardly from the deck of the carrier into the hold to thereby demolish the slurry walls. This device is removable and its essential parts are designed to be replaceable with other parts to accommodate different hold dimensions, so that use is practical in all carriers. The device alternatively may include a backdozer which also uses a reciprocating edge extending from its boom. The device disclosed here thereby provides for a safe and efficient demolishing operation without relying upon manual labor.

7 Claims, 31 Drawing Figures

FIG. 4-1
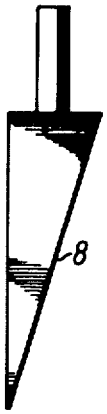
FIG. 4-2
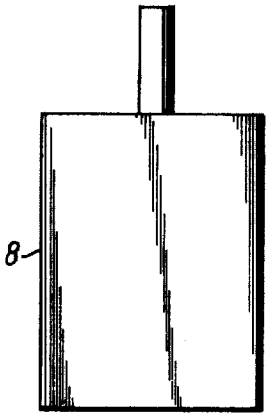
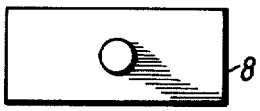
FIG. 4-3
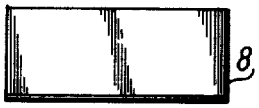
FIG. 4-4
FIG. 4-5
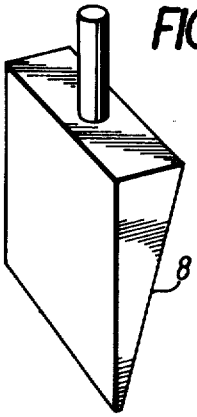
FIG. 5-1
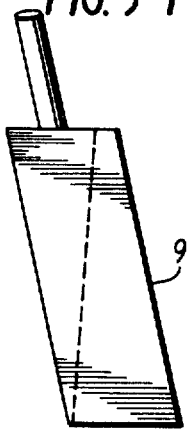
FIG. 5-2
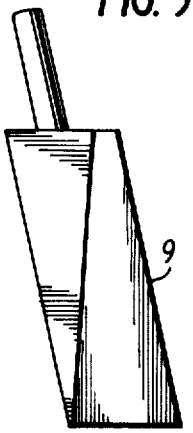
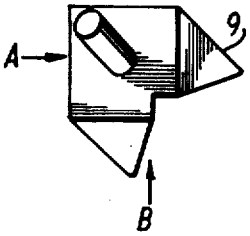
FIG. 5-3
FIG. 5-4
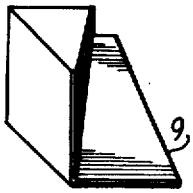
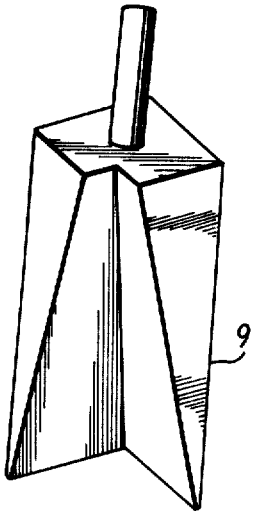
FIG. 5-5

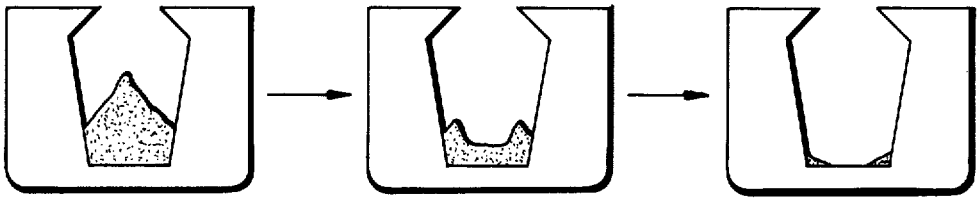
FIG. 10(a) FIG. 10(b) FIG. 10(c)
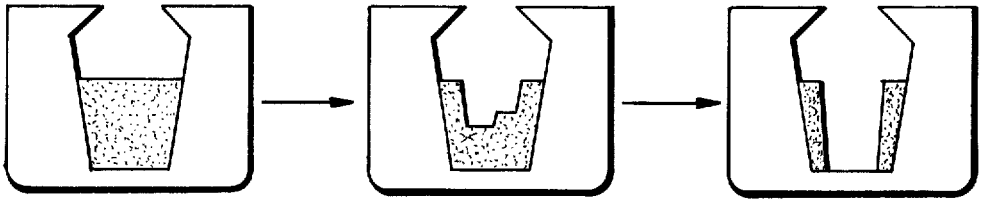
FIG. 11(a) FIG. 11(b) FIG. 11(c)
FIG. 12
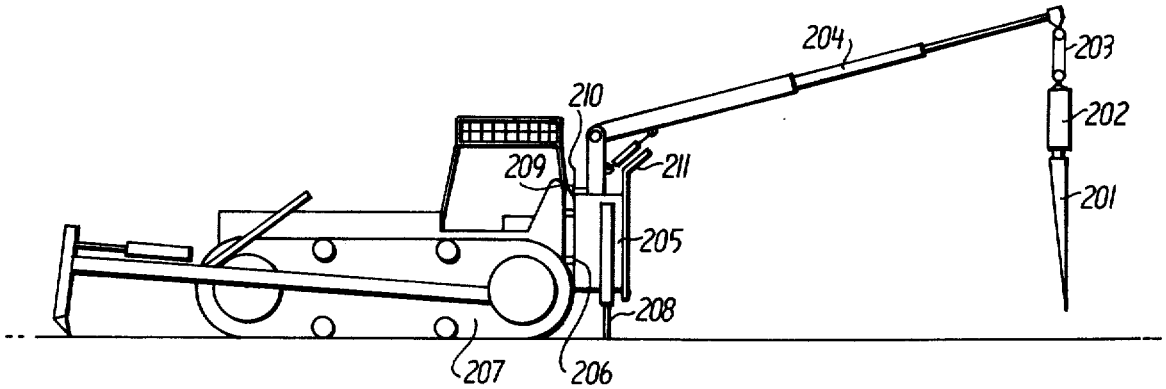

DEVICE FOR USE IN DEMOLISHING A CONSOLIDATED AND HARDENED SLURRY BODY REMAINING IN THE HOLD OF AN IRON-ORE CARRIER

BACKGROUND OF THE INVENTION

1. Field of the Invention

This invention relates generally to a device for use in demolishing, by using the reciprocal movement of an edge, a consolidated and hardened slurry body remaining in the form of a wall along the sidewalls of the hold of an iron-ore carrier, and more particularly to a device used in a wet-loading and dry-unloading method for iron-ore loaded in a slurry state in the carrier hold.

2. Description of the Prior Art

Before proceeding with the description of the present invention, it may be of assistance for a better understanding of the features of the invention to give a detailed description of the background of the so-called "wet-loading and dry-unloading system" used in transporting iron-ore in a slurry state from a mine via ocean to a refinery, including the use of an iron-ore transport ship or carrier.

Heretofore, two types of iron-ore transportation systems have been proposed, one being called the "dry-loading and dry-unloading system", and the other being referred to as a "wet-loading and wet-unloading system".

The iron-ore as used herein refers to a magnetite of a lower iron content, which is supplied in a fine powder after being crushed and dressed by a known method.

The size of this fine powder is that of about 44 $\mu$ particles, which usually amounts to about 80% of the total amount of the iron-ore. Because of its very fine size and poor water permeability, this kind of iron-ore causes a number of troublesome and hence uneconomical problems in providing for surface transportation, that is, in the land and sea transportation thereof.

For simplifying the description, the disadvantages or problems associated with the above two transportation systems will be enumerated below according to the type of system.

a. Dry-loading and dry-unloading system

In this system which has long been practiced, iron-ore is transported by land carrier, such as trucks or railroad, from a mine to a shipping harbor, where a huge ore transport ship or carrier, such as one having a load displacement of about 160,000 tons is loaded with the dry ore by belt conveyors or the like. Then, when the ore carrier arrives at an unloading harbor, the dry ore is unloaded by a crane or the like after the carrier has approached the quay. The disadvantages of this system are as follows:

1. The transportation expense is extremely high because of the use of such land transportation as trucks or railroads;

2. Large scale harbor facilities are required, because the huge ore carrier must approach thereto for loading and unloading. Accordingly, the natural conditions of the harbor are predominant factors to the solution of the problems. Therefore, the land transportation expense comprises a major portion of the total transportation expense.

b. Wet-loading and wet-unloading system

This system is designed to solve the problems of high transportation expense required for transporting iron-ore from a mine to an ore carrier. In this system, iron-ore in fine powder form is mixed with water and a pipe line is laid from a mine to a shipping harbor, and if required, the pipe line may be extended to the offing for loading the carrier with iron-ore in a slurry state. This provides very simple and economical facilities for the intended purpose, thereby reducing the expense of transportation to a great extent. However, the disadvantages thereof offset the above benefit, despite the convenience of the transportation facilities. Those disadvantages are as follows:

1. A large reservoir or pond is needed near the shipping harbor for storing a great amount of iron-ore in a slurry state for subsequent loading, as opposed to the simple land-piling of iron-ore of the former system. Thus, a broad site is required for such reservoirs.

2. At the unloading harbor, a large dehydrating facility is required for handling the bulky iron-ore in its slurry state. This requires the same scale of harbor facilities and unloading equipment as those used in the former system, and thus leads to duplicate investment.

3. During the long period of sailing of the iron-ore carrier, the iron-ore in a slurry state loaded in the carrier sediments by its gravity and then consolidates.

This unfavorable phenomenon is an extremely troublesome problem which is experienced in the transportation of the slurry ore. More particularly, once the iron-ore is loaded in the hold of a carrier, the iron-ore particulates begin with sedimentation at a relatively higher rate, while being accelerated due to the pressure or gravity of the upper layer of the slurry, with the result that the water content of the slurry is reduced from 30 to 40% at the time of loading to about 14% before sailing. As time goes on, the slurry in the hold of the carrier is further consolidated with the aid of the vibration, pitching and rolling of the carrier. As a result, the water content in the slurry is reduced further to about 7% to 8%. This value is naturally dependent on the time period of the navigation, but it has been found to range from 8% to 10% for normal sailing periods. The water content in the slurry exhibits gradual decrease from the top to the bottom of the slurry body due to the gravity of the slurry, thus leaving above the top layer of the slurry the water which has been wrung out from the slurry body due to its gravity sedimentation. The slurry body consolidated in this manner thus presents a considerably great resting angle or stability of shape, and therefore the sedimented slurry body may not crumble even if it remains in the form of a vertically extending wall along the sidewalls of the hold of the carrier, although it may be demolished by driving a tool having a sharp edge thereinto.

Meanwhile, such a consolidated slurry body may be again restored to a slurry state by spraying water thereinto under pressure to transport it to a refinery a long distance away from the unloading harbor. However, this attempt apparently results in extremely higher expense of the transportation facilities with considerable difficulties and thus is impracticable.

With those difficulties in mind, further description of the background of the invention will now be given.

When the gravity sedimented and consolidated slurry body contained in a hold is unloaded with a grab-bucket of the conventional type, there are many difficulties, because of the uniformity or levelled top surface of the slurry body and its compactness.

Therefore, in this invention, the slurry body may be unloaded by using grab-buckets of a heavy-duty type, while leaving a slurry body of a wall form along the sidewalls of the hold of the carrier. The wall of the slurry body which is left remaining is caused by the failure of the grab-buckets to be able to reach the sidewalls of the hold, which in turn results from the poor hatch design and the like, Generally, the amount of such remaining slurry body corresponds to about 30 to 40% by volume of the total slurry body.

It is dangerous for an operator, however, to demolish such a slurry body of a wall form which remains along the sidewalls of the hold of a carrier, when having recourse to conventional tools, such as a backdozer.

SUMMARY OF THE INVENTION

Accordingly, it is a principal object of the present invention to provide a device for safely and efficiently demolishing the consolidated and hardened slurry body remaining in the form of a wall along the sidewalls of the hold of an iron-ore carrier.

It is a further object of the invention to provide a device of the kind described for demolishing the consolidated and hardened slurry body remaining in the form of a wall along the sidewalls of the hold of an iron-ore carrier having removable parts to permit ready replacement to adjust the device for use on iron-ore carrier holds of different dimensions.

It is a still further object of the invention to provide a device which uses a backdozer, is safely and efficiently operable, and has a reciprocating edge suspended from its boom, which is capable of movement back and forth in its axial direction.

The foregoing and other related objects can be readily attained in a device according to this invention which uses a horizontally disposed extensible arm having reciprocating edges at its opposite ends and which can be moved downwardly into the hold of an iron-ore carrier for having the edges driven into the slurry body for demolishing the same. The arm is affixed to an elongated vertically oriented inner cylinder which is extensible and retractable in a telescopic relation from an outer cylinder which is mounted on a turning means, or turntable to allow the turning of the arms through a given angle. The turning means is further mounted on a laterally traveling platform which is then mounted on a longitudinally traveling platform mounted on the opposing edges of a hold opening, or a hatch, such that the arm can assume any desired position within the hold. One of the reciprocating or demolishing edges of the arm has a flat shape to match the flat sidewalls of the hold and another has an appropriate shape which is in register with the corners of the hold. The arm can be turned through a desired angle by rotating the turntable, such that the edge having a flat shape can be applied to each of the sidewalls of the hold and the other edge is applicable to each of the corners thereof.

According to another aspect of the invention, the device alternatively comprises a backdozer provided with a boom, from which is suspended a reciprocating means to which is affixed a demolishing edge that is thereby afforded reciprocating movement. By placing the backdozer described into the hold, the slurry body remaining in the form of a wall along the sidewalls of the hold may be readily demolished with safety, which is afforded by the provision of an iron plate protector provided in an operator station thereon.

BRIEF DESCRIPTION OF THE DRAWINGS

The foregoing and other objects, features and attendant advantages of the present invention will be more fully appreciated as the same becomes better understood from the following detailed description when considered in connection with the accompanying drawings wherein like reference numerals designate like or corresponding parts throughout the several views and in which:

FIG. 4-1 is a side elevation of a demolishing edge of the arm of the present device adapted for use in demolishing the flat surfaces of the sidewalls;

FIG. 4-2 is a front view of the edge shown in FIG. 4-1;

FIG. 4-3 is a top view of the edge of FIG. 4-1;

FIG. 4-4 is a bottom view of the edge of FIG. 4-1;

FIG. 4-5 is a perspective view of the edge of FIG. 4-1;

FIG. 5-1 is a side elevation of a demolishing edge adapted for use in demolishing the slurry body remaining in the corners of the hold, as viewed from the arrow direction A of FIG. 5-3;

FIG. 5-2 is a front view of the edge of FIG. 5-1, as viewed from the arrow direction B of FIG. 5-3;

FIG. 5-3 is a top view of the edge of FIG. 5-1;

FIG. 5-4 is a bottom view of the edge of FIG. 5-1;

FIG. 5-5 is a perspective view of the edge of FIG. 5-1;

FIGS. 10 (*a*), 10(*b*) and 10(*c*) are cross-sectional views of the hold of the carrier, showing the changes occurring in the conventional dry ore during the unloading operation;

FIGS. 11(*a*), 11(*b*) and 11(*c*) are cross-sectional views of the carrier hold showing the changes occuring in the consolidated and hardened slurry body during the unloading operation;

FIG. 12 is a side elevation of a backdozer, i.e., a second embodiment of this invention, provided with the demolishing means of the invention.

DESCRIPTION OF THE PREFERRED EMBODIMENTS

The demolishing operation as used herein is to be carried out in the stage where most of the inner portion of the consolidated and hardened slurry body has been unloaded by means of grab-buckets, with some difficulties, but in which the consolidated slurry body in the form of a wall has been left remaining along the sidewalls of the hold. In this respect, the slurry wall is stable in shape and thus cannot be expected to crumble of its own accord from the sidewalls of the hold.

FIG. 1 through FIG. 5 specifically refer to an arm having reciprocating edges at the opposite ends thereof and the shapes thereof. The iron-ore carrier used as an example herein is of a load displacement 160,000 tons, the dimensions thereof being 280 m in length, 47.40 m in width, 24.80 m in depth, while the hold thereof is 51.6 m in length, 20.7 m in average width, and 21.6 m in depth.

Figure 1:
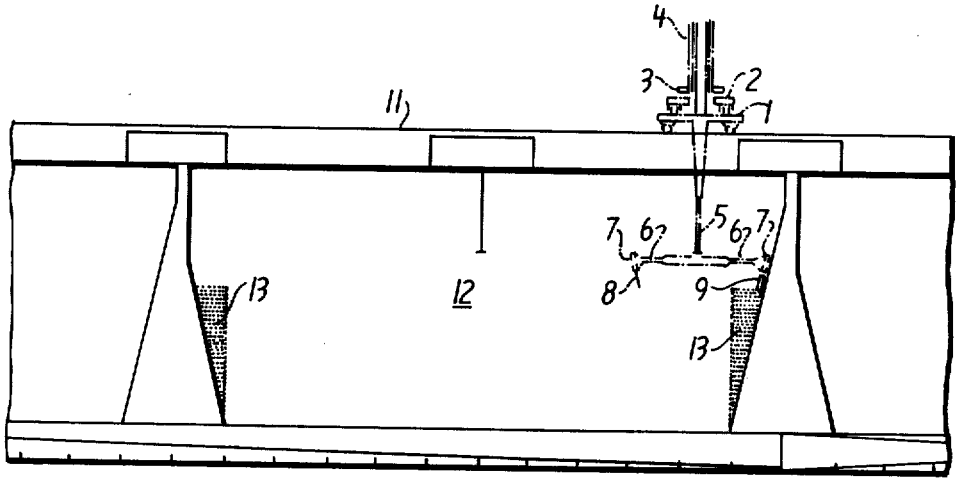
FIG. 1 is a schematic view of one embodiment of the present invention operatively engaging the slurry body remaining in the corners of the hold while performing a demolishing operation thereon.
Figure 2:
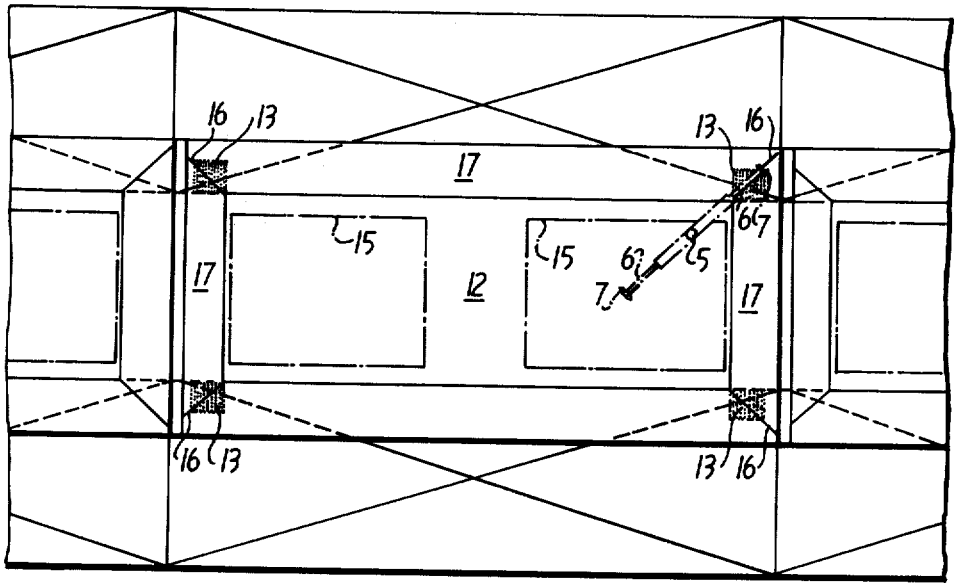
FIG. 2 is a plan view of FIG. 1.
Figure 3:
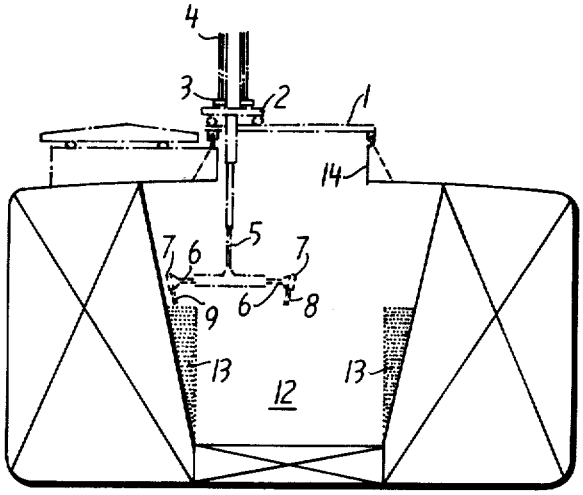
FIG. 3 is a cross-sectional view taken along an edge portion of the hold.

Referring now to the drawings and in particular to FIGS. 1 through 3, the major components of the demolishing device according to the present invention may be seen to consist of a longitudinally traveling platform 1 and a laterally traveling platform 2 carried thereon which are disposed on the carrier deck and having mounted thereon a turning means or turntable 3 rotatably mounted on the platform 2 for rotation about a substantially vertical axis and carrying an outer or supporting cylinder 4 and an extensible inner cylinder 5 having diametrically opposed arms 6 fixed at the lower end thereof and lying in a plane perpendicular to the vertical axis of rotation of the cylinder on which an edge 8 adapted for use in demolishing the slurry body remaining on the flat surface of the sidewalls of the hold is mounted on the end of one of the arms 6 and a similar demolishing means having an edge 9 adapted for use in demolishing the slurry body remaining in the corners of the hold is mounted on the end of the other arm.

With this arrangement, the longitudinally traveling platform 1 is mounted on rails 11 along an edge 14 of the hatch opening for movement longitudinally of the hold, such that the laterally traveling platform 2 carrying the turntable 3 and the arms 6 supported thereby may be moved in their entirety in a longitudinal direction of the carrier.

The laterally traveling platform carries thereon the turning means 3 and the arm 6, including the edges 8 and 9, and hence they move in entirety in a lateral direction of the carrier.

The turning means or turntable 3 is adapted to turn the supporting or outer cylinder 4, and hence the arm 6, around the center line of the laterally traveling platform 2. The supporting outer cylinder 4 is adapted to support the extensible inner cylinder 5 therein, such that the inner cylinder 5 can be housed in or withdrawn into the outer cylinder 4.

A plurality of extensible inner cylinders 5, being 5 in number in this embodiment, may be provided to form a telescopic construction for supporting the arm 6 which is attached to the lower end thereof and which extends in horizontal opposite directions therefrom, respectively, the inner cylinder being extendable from the outer cylinder in a downward direction into the hold.

The horizontally extensible arm 6 has a pair of demolishing or reciprocating means 7 at its opposite ends and also is of an extensible construction, thereby permitting adjustment of the length of the arm being extended.

The demolishing means may be of a conventional type, such as a breaker used in the civil engineering field, the breaker used in this embodiment being so designed as to produce reciprocal movement for the edge in its axial direction.

Figures 1, 13:
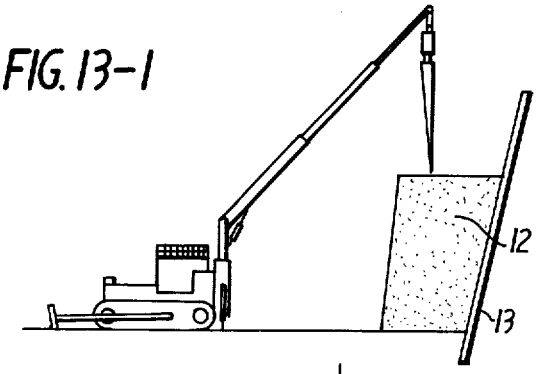
FIG. 13 shows the progress of an unloading operation in seven sequential diagrammatic views when using the demolishing device of the present invention.
Figures 2, 13:
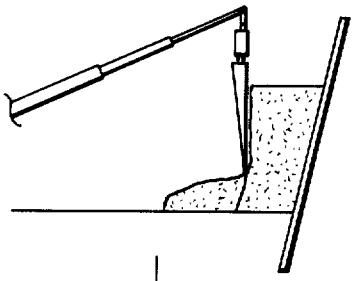
Figures 3, 13:
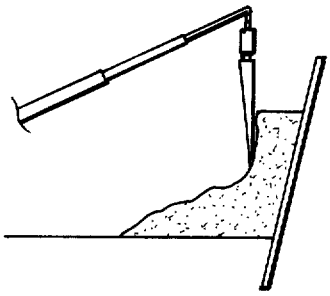
Figures 4, 13:
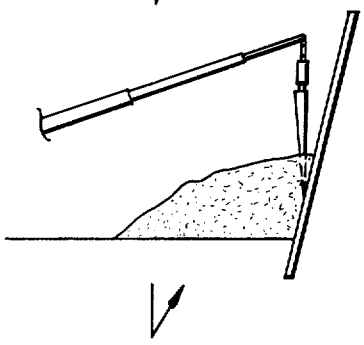

The edge 8 provided for the flat surface of the sidewalls of a hold is of a shape which well matches the flat portion 17 of a hold 12 and, as shown in FIG. 4, has a wedge-shaped configuration. In this embodiment, the width of the edge may be approximately 750 mm, for example, because the hardness of the consolidated and hardened slurry body is not too great, in contrast to the conical shape of the edge of a conventional crusher for crushing an extremely hard matter.

Figures 5, 13:
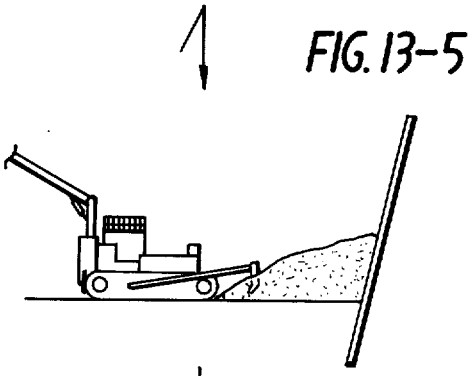
Figures 6, 13:
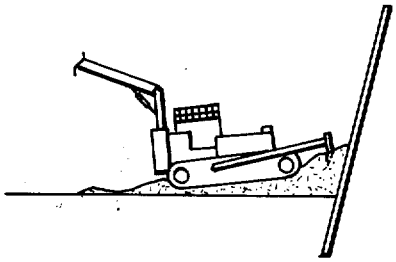
Figures 7, 13:
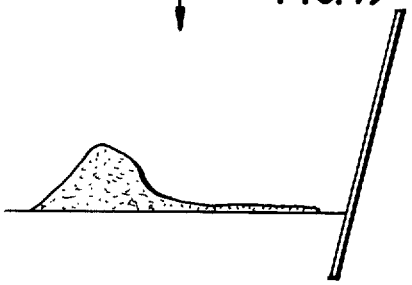

The edge 9 provided for the corners of the hold is adapted to demolish the slurry body remaining in the corners 16 of the hold 12 efficiently and without damaging the hold corners, and thus has a shape matching with that of the corners. In this embodiment, the corner 16 is shown being formed with the longitudinal and lateral sidewalls thereof both having an inclined angle of 78°, such that the edge is constructed in an L-shaped configuration in a horizontal cross-section and in a wedge shape in the vertical cross-section, as shown in FIGS. 5-1 and 5-2.

The consolidated and hardened slurry body is produced by crushing the iron-ore to a fine powder, followed by a mixing with water so as to give a slurry state, loading the same in a carrier and then subjecting the same to a dehydrating process in the carrier, such that it presents about 8% water content, an apparent specific gravity of about 4, and an "N" value for a standard penetrating test of about 20, the value "N" used in the standard penetrating test herein being defined according to JIS (Japanese Industrial Standard) A1219 as the dropping cycles of a weight or block of 63.5 kg dropped from a height of 75 cm upon a pipe of 51 mm in diameter to drive the same into the ground to a depth of 30 cm.

Meanwhile, when the majority of the slurry body 13 in the hold 12 has been demolished by means of the edge 8 for the flat portion, thereby leaving the slurry body 13 only in the corners 16 of the hold 12, then the horizontally extensible arm 6 is turned through 180° by means of the turning means 3 to cause the corner edge 9 on the other end of the arm to replace the positon of the flat edge 8, with the direction of the arm 6 being aligned with the diagonal of the hold. In this embodiment, the arm 6 is positioned at 45° to the center line of the carrier.

Then the corner edge 9 is moved toward the corner 16, while the inner cylinder 5 is extended downwardly with the demolishing means being operated, thus carrying out the demolishing operation of the slurry body remaining in the corners 16. In this respect, the extensible arm is so designed as to be retracted with the descending corner edge 9 along the corner 16, thereby precluding the possibility of leaving a portion of slurry body undemolished and of causing damage to the corner 16 of the hold.

The advantages of the device of the present invention can be summarized as follows:

1. A proper weight balance of the entire demolishing device can easily be maintained because the arm 6 extending horizontally from the lower end of the extensible or inner cylinder 5 has demolishing means 7 at the opposite ends thereof, respectively. In addition, two kinds of edges can be provided, such as a flat edge 8 and corner edge 9.

2. Since the flat edge 8 affixed to the demolishing means 7 is of a shape to match with the flat portion of the sidewalls of the hold and the corner edge 9 affixed to the other demolishing means 7 has a shape to match the corners of the hold, there is no possibility of leaving a portion of slurry body undemolished nor causing damage to the corners of the hold, whereby the demolishing operation can be carried out safely and efficiently.

3. Since the horizontally extensible arm 6 can be ned through 180° about the center line of the exten- le or inner cylinder 5, either of the edges 8 or 9 can adily be directed to the wall of the slurry body, de- nding on the configuration thereof.

Figure 6:
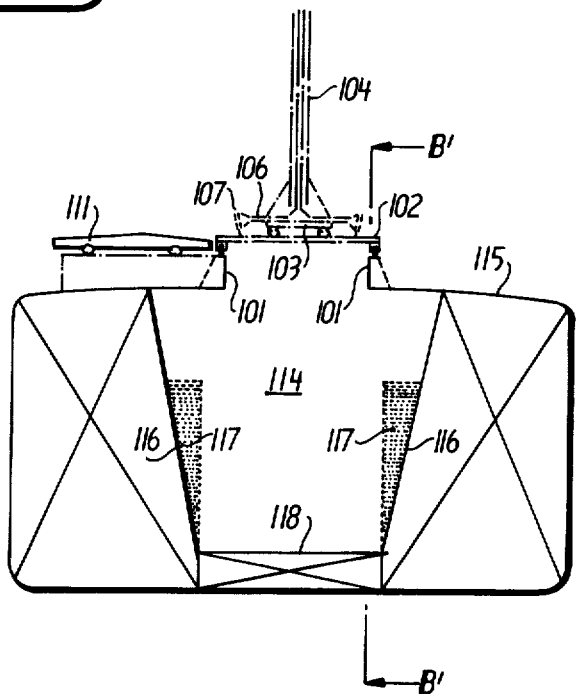
FIG. 6 is a cross-sectional view of a demolishing device according to this invention shown moving on the opposing edges of the hatch opening, and taken along the line A′—A′ of FIG. 9.
Figure 7:
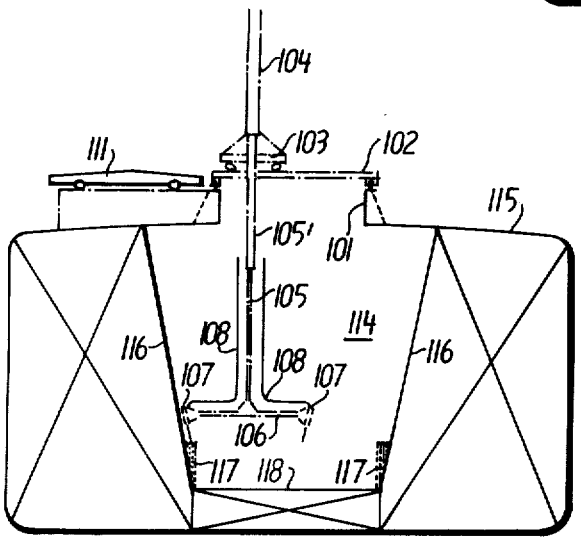
FIG. 7 is a cross-sectional view of the demolishing device of FIG. 6 which has completed the demolishing operation on the slurry body remaining along the longitudinal sidewalls of a hold.
Figure 8:
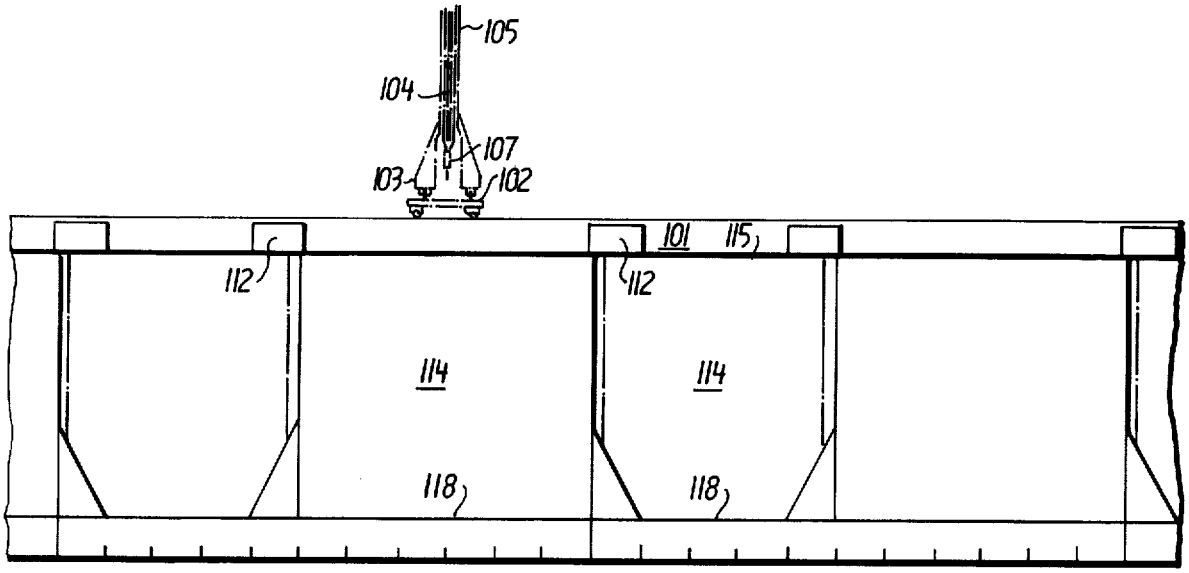
FIG. 8 is a longitudinal cross-sectional view of the demolishing device of this invention taken along the line B′—B′ of FIG. 6.
Figure 9:
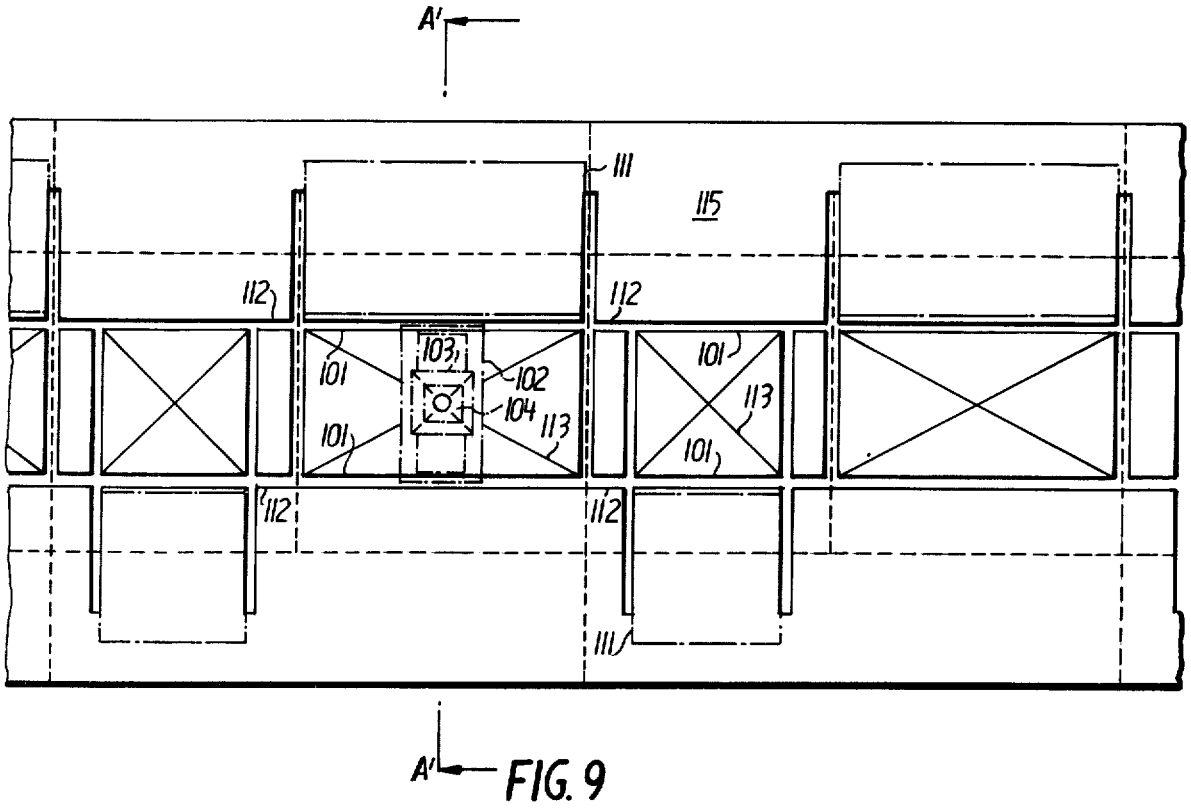
FIG. 9 is a plan view of the upper deck of the carrier, shown in the condition of FIG. 6.

Turning now to FIGS. 6 through 8, in which are own the construction of the longitudinally and later- y traveling platforms, along edges 101 of the hold, ere is disposed a longitudinally traveling platform 2 on which a laterally traveling platform 103 rides, d a supporting or outer cylinder 104 is carried ereon, from which an extensible inner cylinder 105 pends. The horizontally extensible arm 106 is ounted at the bottom end of the extensible inner linder 105 and a demolishing or reciprocating means 7 is disposed at the opposite ends thereof.

In addition, the opposing edges 101 of the hatch ening not only serve to support the oil-tight covering 1 but also serve as rails for the longitudinally travel- g platform.

According to another aspect of the invention, each t of opposing edges 101 of different hatches are cou- ed with connecting rails so that the longitudinally aveling platform 102 can be moved throughout the tire length of the hatch compartments, longitudinally the carrier. More particularly, the longitudinally aveling platform 102 can be moved on the edges 101, at is on the rails of the hatch openings and the con- cting rails 112, with the laterally traveling platform ing carried thereon. The longitudinally traveling atform 102 is provided with four wheels at the under- de of the square frame thereof and can be driven by eans of a Diesel engine, or the like.

The most important feature of the longitudinally aveling platform is that it can be removed as required. The laterally traveling platform 103 can be moved terally of the carrier on rails provided on the longitu- nally traveling platform 102, with the supporting or ter cylinder 104 being mounted thereon, and also ay be driven by a Diesel engine or the like, and it too provided with four wheels on the underside thereof. ike the longitudinally traveling platform 102, the lat- ally traveling platform 103 can also be removed from e longitudinally traveling platform 102, as desired.

The supporting or outer cylinder 104 supports the tensible inner cylinder 105 and maintains the inner linder 105 extended into the hold 114 during a emolishing operation, while keeping the same re- acted into the outer cylinder 104 during the traveling ver a plurality of holds 114 to thereby permit free aveling of the longitudinally traveling platform 102 a the connecting rails 112 from one hold or hatch erefor to the other.

The extensible inner cylinder 105 serves to support e horizontally extensible arm 106. The number of the ner cylinders 105 of the telescopic construction and e lengths thereof can be determined by the depth of e hold 114 and the clearance between the upper deck 15 and the unloader, not shown, on the quay side, hen approaching to the quay.

In this embodiment, as shown, however, the extensi- le inner cylinders are two in number and are adapted be actuated by means of hydraulic pressure.

The horizontally extensible arm 106 can maintain the emolishing means 107 at a desired attitude, and pres- nts preferable weight balance, as hereinbefore de- cribed, because of having the demolishing means 107 isposed at each end thereof, thereby allowing the access of an arm end to the slurry body 117 remaining on the longitudinal partition wall 116. Furthermore, of course, the width of the arm 106 is so designed as to be short enough for permitting free passing through the hatch opening 113.

The arm 106 can be readily removed from the lower end of the extensible inner cylinder 105 and can be replaced with another arm whose dimensions are more well adapted to those of the hatch 113, where different size hatch openings are encountered.

The demolishing means 107 serves to demolish the slurry body 117 remaining on the longitudinal partition wall 116, and a breaker of conventional type as used in the civil engineering field can be used for this purpose, as hereinbefore described. In this embodiment, a hydraulic type breaker is preferably used rather than a pneumatic type. The hydraulic pressure can be applied to the demolishing means 107 through a hydraulic pipe 108 from a pressure generating means, not shown, which may be mounted on the laterally traveling platform 103.

In operation, when an iron-ore carrier approaches a quay, all oil-tight hatch coverings 111 are moved sidewise, and two rails are thus formed running over all hatch compartments longitudinally throughout the length thereof by using the opposing edges 101 of the hatch opening and connecting rails.

Subsequently by utilizing an unloader prepared at the quay side, the longitudinally traveling platform 102 at the same quay side is transferred onto the connecting rails 112 which will not interfere with the operation of grab-buckets, after which the laterally traveling platform 103 is placed on the rails on the longitudinally traveling platform 102.

In this embodiment, the unloader is capable of lifting a material weighing 47 tons, while the longitudinally traveling platform weighs about 8 tons and the laterally traveling platform about 10 tons, thus presenting an ample capacity.

For demolishing the slurry body 117 remaining in the form of a wall along the longitudinal partition wall 116, as shown in FIG. 7, the extensible inner telescopic cylinders 105, 105', housed in the supporting or outer cylinder 104, ia moved on the opposing edges 101 of the hatch opening or connecting rails 112 to the desired hatch opening 113, with the demolishing means 107 retracted into the laterally traveling platform 103. The dimensions of the supporting or outer cylinder 104 are such as to permit its passing under the unloader at the quay side, thus resulting in no interference with the unloading operation using the unloader.

Then, as shown in FIG. 7, the extensible inner cylinder 105 is extended downwardly into the hold 114, with the demolishing means 107 being operated to thereby demolish the slurry body 117.

At this time, it is necessary to adjust the attitude of the horizontally extensible arm 106 attached to the demolishing means 107, such as, for instance, to place it in parallel relation to the longitudinal partition wall 116, and further to predetermine the extensible length of the inner cylinder 105 so as not to approach within 2 meters of the inner bottom plate 118 of the hold. This precludes damage to the carrier body, such as to the longitudinal partition wall or an inner bottom plate 118, due to interference with the demolishing means 107.

The features of the longitudinally and laterally traveling platforms may be summarized as follows:

1. Because the longitudinally traveling platform 102 adapted to travel on the edges 101 of the hatch opening is removable therefrom, a whole set of demolishing device components, such as the platforms 102 and 103, the supporting outer cylinder 104, the extensible inner cylinder 105, the horizontally extensible arms 106 and demolishing means 107 can be prepared on the quay side beforehand, whereby:

a. There is no need for the device to be equipped for each carrier, but instead, it can be commonly used for a plurality of carriers, as required, thus enhancing the utilization efficiency thereof.

b. The maintenance of the demolishing device is simple.

c. Because the demolishing device can be stored on land, space conservation of the carrier is preserved with resultant saving in weight.

2. The laterally traveling platform 103 is also removable from the longitudinally traveling platform 102, whereby:

a. To accommodate different sizes of hatch openings 113, it is only necessary to provide a longitudinally traveling platform 102 whose dimensions well match those of the subject hatch opening, such that all of the components of the complete demolishing device, except for the longitudinally traveling platform, can be used even though different sizes in hatch openings are present.

b. The demolishing device is of a split type as described, such that it is well adapted to easy handling.

3. The horizontally extensible arm 105 is of a telescopic construction and can be housed in the supporting outer cylinder 104 mounted on the laterally traveling platform 103, whereby:

a. A single set of components comprising a complete demolishing device can take care of all of the holds 114 by utilizing the two rails running throughout the entire length of hatch compartments longitudinally of the carrier, the rails consisting of the opposing edges of the hatch openings 101 and the connecting rails 112.

b. Before operating the demolishing device, the height of the supporting or outer cylinder 104 on the upper deck 115 is predetermined so as not to interfere with the unloading operation using an unloader.

4. The horizontally extensible arm 106 attached at its center to the lower end of the extensible inner cylinder 105, is provided with demolishing means 107 at its opposite ends, whereby:

a. The portion 117 of the slurry body, which is located sidewise from the hatch opening 113 and thus is not usually accessible, can now be demolished.

b. If required, the supporting means for the supporting outer cylinder 104 provided on the laterally traveling platform 103 can be modified from a fixed type to a turn table type, such that the portion 117 of slurry body, which is located sideways from the hatch opening or longitudinally of the carrier, may be readily demolished.

As is apparent from the foregoing, the demolishing device of the present invention can accommodate any size of hold of the carrier in a simplified and convenient fashion, while being capable of taking care of a plurality of carriers with a single device. Furthermore, the demolishing or reciprocating edges used are of a shape which well matches the configuration of the sidewalls or corners of the hold to thereby attain the intended demolishing purpose completely, without causing damage to the sidewalls and the bottom plates of the hold. This aids in saving manpower and cost required for unloading such a consolidated and hardened slurry body, and eventually thereby the cost of the steel production.

Referring now to the second embodiment of the demolishing device of the present invention, there is disclosed as an alternative solution to the aforesaid problems a backdozer which is provided with a boom at its tail or side, having similar reciprocating means and an edge as hereinafter described, being adapted to efficiently and safely demolish the slurry body remaining in the form of a wall along the sidewalls of a carrier hold.

Referring to FIGS. 10 and 11 in particular, there are shown changes in the slurry body, being unloaded by means of the grab-buckets, and more specifically FIG. 10 refers to a dry-loading and dry-unloading system, whereas FIG. 11 refers to a wet-loading and dry-unloading system. Shown at (a) herein is the condition preparatory to the commencement of the unloading operation, at (b) an unloading operation in progress, and at (c) the condition of the nearly completed unloading operation.

As in the first embodiment of the present invention, the backdozer is placed into the hold when most of the inner portion of the slurry body has been removed or unloaded by means of grab-buckets, leaving a slurry body in the form of a wall along the sidewalls of the hold. FIG. 12 shows a backdozer provided with a removable type of demolishing means. Suspended from the tip of a boom 204 by means of a wire 203 is a reciprocating means 202, to which is affixed a wedge-shaped edge 201 which serves to accelerate the driving action of the edge into the slurry body for demolishing the same. The reciprocating means 202, and wedge-shaped edge 201 can be moved vertically by means of a wire which runs from a hydraulic motor 205 through an extensible hydraulic boom 204. The hydraulic motor and boom supporting portion can be affixed to the rear of the backdozer 207 by using fastening means 206, while being supported by hydraulically actuated legs 208 with respect to the ground. The boom 204, hydraulic motor 205 and legs 208 can be driven via hydraulic hose 209 by a hydraulic pump on the backdozer 207. The operator station 210 and motor are protected by an iron plate 211 from the slurry being demolished.

FIG. 13 refers to the progress in the unloading operation according to this embodiment of the present invention. The progressive illustrations therein are self-explanatory and thus detailed description is omitted. FIGS. 13-1 to 13-4 show the wedge-shaped reciprocating edge 201 being pierced into the slurry body 212 which is then gathered to the center portion of the hold by virture of the primary function of the backdozer, as shown in FIGS. 13-5 to 13-7.

This type of backdozer obviously increases the efficiency of the unloading operation with improved safety.

It will be understood that the above description is merely illustrative of preferred embodiments of the invention. Additional modifications and improvements utilizing the discoveries of the present invention can obviously be readily anticipated by those skilled in the art in light of the present disclosure. Accordingly, it is to be understood that within the scope of the appended Claims the invention may be practiced otherwise than as specifically described herein.

What is claimed as new and desired to be secured by Letters Patent of the United States is:

1. For use in the wet-loading and dry-unloading of an iron-ore carrier which is loaded with iron-ore in a slurry state in its hold, a device for demolishing, by using reciprocal movement, a consolidated and hardened slurry body remaining in the form of a wall along the side walls of said hold comprising:

a first platform mounted on the opposing edges of a hatch opening of said hold capable of moving longitudinally of said carrier;

a second platform mounted on said first platform being movable laterally of said carrier;

a turning means mounted on said second platform and being turnable about an axis perpendicular to said platforms through a given angle;

an outer cylinder mounted on said turning means in parallel relation with said axis of turning and turnable therewith and having an inner cylinder extensible therefrom vertically downward into said hold and retractable relative to said outer cylinder; and arm members being extensible from and retractable toward said inner cylinder solely in a horizontal plane and attached to the lower end thereof extending in horizontally opposite directions therefrom, and provided with a pair of demolishing edges disposed substantially perpendicular thereto at opposite ends thereof, respectively, one of said edges having a configuration corresponding to the corners of said hold while the other one of said edges has a configuration corresponding to the flat sidewalls of said hold whereby said edges may be utilized alternatively in demolishing portions of said slurry body remaining within said corners of said hold and along said sidewalls of said hold as a result of selective rotation of said turning means.

2. A device as set forth in claim 1, wherein said first and second platforms are removable.

3. A device as set forth in claim 1, wherein said arm member may be extended and retracted while the vertical positioning of said arms is being changed by operation of said inner cylinder.

4. A device as set forth in claim 1, wherein said pair of demolishing edges are removable and interchangeable for attachment.

5. A device as set forth in claim 1, wherein said inner cylinder is formed of a plurality of cylinders in telescopic relation.

6. A device as set forth in claim 1, wherein said demolishing edges are vibratable.

7. A device as set forth in claim 1, wherein said second platform runs on said first platform with said arm member retracted and with said demolishing edges positioned above said first platform.

* * * * *